United States Patent [19]

Goldberg

[11] 4,036,498

[45] July 19, 1977

[54] NOVELTY DISC MANIPULATING DEVICE

[76] Inventor: Burton D. Goldberg, 15109 Watergate Road, Silver Spring, Md. 20904

[21] Appl. No.: 680,844

[22] Filed: Apr. 27, 1976

[51] Int. Cl.[2] ..... A63B 67/06

[52] U.S. Cl. ..... 273/101; 273/102 R; 273/106 B

[58] Field of Search ..... 273/85, 95 R, 95 F, 273/101, 102 R, 102 S, 105 R

[56] References Cited

U.S. PATENT DOCUMENTS

| | | | |
|---|---|---|---|
| 2,819,083 | 1/1958 | Schiffman | 273/101 |
| 2,959,415 | 11/1960 | Peterson | 273/95 R |
| 3,193,292 | 7/1965 | Mehelich | 273/101 |
| 3,231,277 | 1/1966 | Holland | 273/101 |
| 3,441,278 | 4/1969 | Edwards | 273/101 |
| 3,857,564 | 12/1974 | Goldfarb | 273/85 F |

FOREIGN PATENT DOCUMENTS

| | | | |
|---|---|---|---|
| 82,350 | 1956 | Denmark | 273/101 |
| K17,262 | 1956 | Germany | 273/101 |
| 7,088 | 2/1897 | United Kingdom | 273/101 |

*Primary Examiner*—Richard C. Pinkham
*Assistant Examiner*—L. E. Anderson
*Attorney, Agent, or Firm*—Roylance, Abrams, Berdo & Kaul

[57] ABSTRACT

An amusement device in the form of a novelty disc manipulating device wherein an upstanding housing with transparent side walls has a narrow internal chamber through which a disc can be movably manipulated. A pivotally mounted operating lever is disposed adjacent to the bottom of the housing and includes a projecting portion which can be digitally engaged. A disc, advantageously a coin, is disposed within the chamber and normally rests on edge upon the top of the lever. At one upper corner of the housing, an angularly disposed rebound surface is provided. A support shelf is spaced somewhat beneath the other upper corner of the housing. When the lever is depressed, the disc is propelled upwardly to bounce off the rebound surface, against the top of the housing, and hopefully onto the support shelf. If the disc fails to stay on the support shelf, it gravitationally drops onto the top of the lever and the lever is again operated, until the disc is successfully positioned on the support shelf.

5 Claims, 3 Drawing Figures

NOVELTY DISC MANIPULATING DEVICE

This invention relates to an amusement device and more particularly it relates to a novelty disc manipulating device which forms a game of skill to provide an enjoyable diversion for adults and children.

While there are many known forms of novelty devices, there still exists a need for a simple novelty device which is inexpensive to manufacture, attractive in appearance, yet remains simple and easy to operate. The game of the subject invention not only meets these objectives, but additionally, provides a unique and attractive ornament which can be placed on desks, coffee tables and the like. Moreover, when the disc being manipulated is a coin, as is advantageously the case, the very presence of the coin constitutes a feature which attracts attention to the device.

The objectives of the present invention are attained by providing a vertical or upstanding housing having closely spaced transparent side walls which define between them, a norrow internal chamber slightly wider than the disc which is disposed therein. The disc is advantageously a coin, although other forms of discs can be readily used. A pivotally mounted operating lever is provided adjacent to the bottom of the housing and includes a projecting portion which extends beyond the housing and which can be digitally engaged. The disc disposed within the housing chamber rests on its edge upon the top of the lever. At one upper corner of the housing, an angularly disposed rebound surface is provided. Spaced somewhat beneath the other upper corner of the housing, there is provided a support shelf upon which the disc can advantageously rest, once it has been flipped thereonto by operation of the lever. As the lever is depressed, the disc is propelled upwardly to bounce off the rebound surface, against the top surface of the housing, and hopefully onto the rebound shelf. In the event that the disc misses the rebound shelf or bounces or rolls off it, it gravitationally drops back onto the lever. The lever is operated repeatedly and the disc is thus repeatedly bounced up and down within the chamber in the housing until the disc is successfully positioned upon the support shelf.

Referring now to the drawings which form a part of the original disclosure of this invention:

Figure 1:
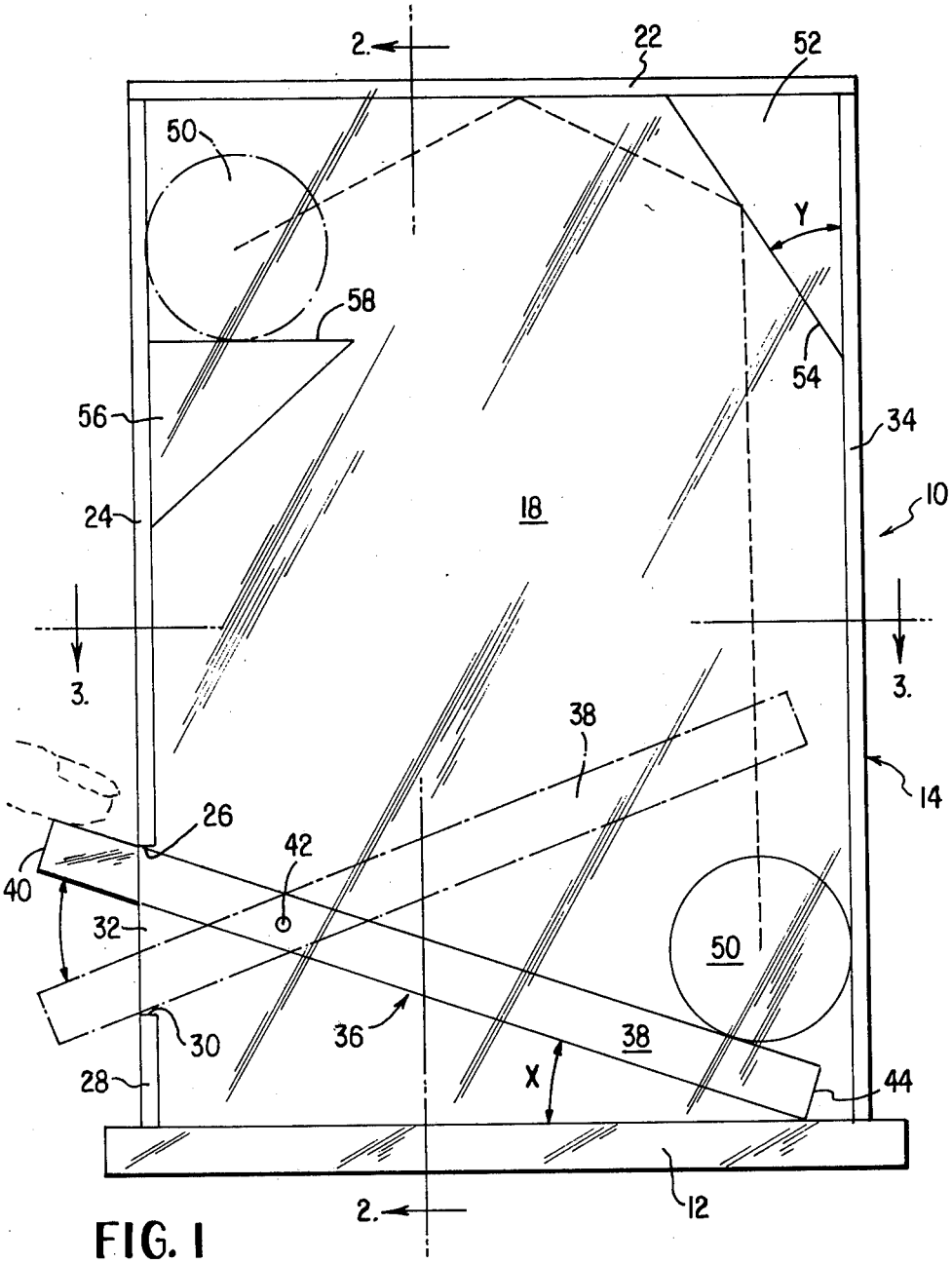
FIG. 1 is a side elevational view of a novelty disc manipulating device in accordance with the principles of the present invention.
Figure 2:
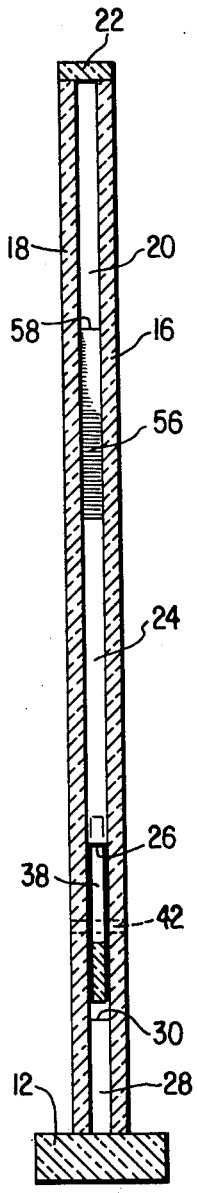
FIG. 2 is a longitudinal sectional view thereof taken along the line 2—2 of FIG. 1.
Figure 3:
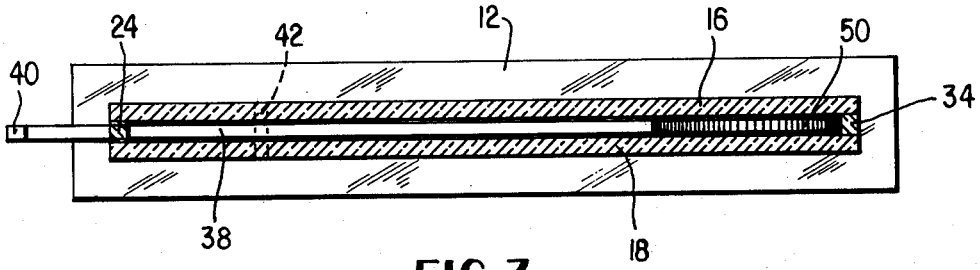
FIG. 3 is a transverse sectional view thereof taken along the line 3—3 of FIG. 1.

Referring now to the drawings in further detail, the novelty disc manipulating device is generally designated 10. It includes a flat base 12 which is adapted to sit upon a support surface and upon which is positioned an upstanding housing generally designated 14.

The housing 14 consists of a pair of spaced upstanding vertical side walls 16 and 18 which define between them, a norrow internal chamber 20. The wall 16 and 18 formed at least in part and preferably entirely of a transparent material, advantageously a transparent plastic material. The lower end of each side wall 16 and 18 is attached to the base member 12. The upper end of the side walls 16 and 18 is closed by a top wall 22. A first end wall 24 extends along one edge of the side walls 16 and 18 from the top wall 22, but terminating somewhat short of the base 12 at a terminal edge designated 26. A lower side wall portion 28 extends along the same edge of the side walls and down to the base member 12. This lower end wall portion 28 has an upper edge 30 which is spaced somewhat beneath the edge 26 on the end wall 24. As such, an opening 32 is formed within this end wall between the edges 26 and 30. At the opposite edge of the side walls 16 and 18, a second end wall 34 extends completely from the top wall 22 to the base 12.

The amusement device of the present invention includes an operating lever generally designated 36. The operating lever 36 is in the form of a flat bar or link 38 disposed in the internal chamber 24 but having an outer end 40 which projects through the opening 32 to extend outside the housing. A pivot member 42 in the form of a pivot pin or the like extends between the side wall 16 and 18 and extend centrally through the lever body 38, thus pivotally mounting the lever. The inner end 44 of the lever can advantageously abut against the base 12 when the lever is at its normal rest position, thus defining an angle designated $x$ in FIG. 1 between the lever 38 and the base 12. The value of this angle $x$ is no greater than 30° and preferably is somewhat less than that amount. As shown in FIG. 1 when the user's finger engages the projecting portion 40 of the lever and presses the same downwardly, the lever is pivotally moved from its solid line position to its phantom line position. Downward movement of the lever is limited by engagement of the lever lower surface against the edge 30 on the wall portion 28. Upward movement of the lever is limited by engagement of the lever inner end 44 against the base, or alternatively, by engagement of the lever top surface with the terminal edge 26 of the end wall 24.

A circular disc member 50 is disposed within the internal cavity 20 in the housing. This disc member can advantageously be a coin, such as a United States coin having a valuation of 50 cents. Alternatively, it can be a foreign coin, any other form a metallic disc or medallion, or even an advertising disc which could have advertising indicia imprinted on the outer surfaces thereof. The thickness of the disc member is slightly smaller than the width of the internal cavity 20 so that the disc can move freely within such cavity but without tipping sideways. In any event, the disc thickness is less than the width of the internal cavity 20 but the disc diameter is considerably greater than the thickness of such cavity.

A rebound member 52 is disposed in the upper corner of the housing and includes a rebound surface 54 which extends angularly between the second end wall 34 and the top wall 32. Advantageously, this rebound member 52 can form a triangular transparent plastic element mounted in the upper corner. In any event, the angle $y$ formed between the rebound surface 54 and the second end wall 34 has a value between 30° and 45°.

Finally a support member 56 is provided along the first end wall 24, such support member 56 including a flat support surface 58. Once again, the support member 56 can advantageously be a triangular transparent plastic element adhered to the end wall 24. In any event, the support surface 58 is disposed parallel to the top wall 22 but is spaced beneath such top wall by a distance greater than the diameter of the disc 50. In fact, as can be observed from FIG. 1, the elevation of the support surface 58 is substantially coincident with the point at which the rebound surface 54 engates with the second end wall 34.

In order to understand the operation of the present invention, it will be understood that the disc 50 has sufficient weight so that it will gravitationally drop within the chamber 20 until it comes to rest upon the top surface of the lever 38, as shown in solid lines in FIG. 1. When it is desired to operate the amusement device, the user digitally engages the free end 40 of the lever and depresses the same, thereby moving the lever from its solid line position in FIG. 1 to its phantom line position. Such movement causes the disc 50 to be propelled upwardly through the chamber 20 to bounce off the rebound surface 54, against the top wall 22, and hopefully to have the disc 50 come to rest upon the support surface 58 in the manner shown in phantom lines in FIG. 1. In ordinary usage of the device, however, it will take the user several tries until he or she is finally able to manipulate the disc 50 onto the support surface 58. If the disc 50 is not flipped at exactly the right angle, it will either miss the support surface 58 entirely, or it will bounce or roll off of such support surface and will drop back through the chamber to once again come to rest upon the top of the operating lever 30. The user then repeats the operation of the lever and the movement of the disc until such time as the disc is successfully brought into a rest position upon the support surface 58. While the length of the support shelf or support surface 58 can be varied somewhat, it is preferred that the length be substantially equal to the diameter of the disc 50, thereby increasing the difficulty involved in successfully positioning the disc thereupon.

What is claimed is:

1. An amusement device comprising:

an upstanding housing including a pair of spaced vertical side walls formed at least in part of transparent material;

a pivotally mounted operating lever;

said lever having an inner portion disposed in said housing and an outer portion projecting beyond said housing for digital engagement by an operator;

said housing including a top wall extending across said side walls at the top thereof;

said housing also including a first end wall extending between said side walls above the projecting outer portion of said lever and a second end wall extending between said side walls along the opposite end thereof;

a rebound member within said housing having an angularly disposed rebound surface extending between said top wall and said second end wall;

a support member within said housing including a support surface disposed beneath said top wall, said support member being attached to said first end wall; and a disc disposed within said housing for free movement therein, said disc having a thickness less than and a diameter greater than the spacing between said side walls;

said disc ordinarily resting upon its edge on the inner portion of said operating lever, but said disc being propelled upwardly when digital pressure is applied to the outer portion of said operating lever to contact said rebound surface or said top wall or both and then to bounce toward said support surface, said amusement device having as its objective the placement of said disc on said support surface through operation of said operating lever, said rebound surface forming an angle between 30° and 45° with said second end wall, said support surface having a flat surface parallel with said top wall, said support surface being disposed within said housing at substantially the same elevation where said rebound surface intersects said second end wall.

2. An amusement device as defined in claim 1 wherein said disc is a coin.

3. An amusement device as defined in claim 1 wherein said disc has advertising indicia imprinted therein.

4. An amusement device as defined in claim 1 wherein said lever is mounted upon a pivot member which extends between said side walls.

5. An amusement device as defined in claim 4 wherein said housing includes a base upon which the lower corner of said inner portion of said operating lever normally rests, with said lever in such position forming an angle of less than 30° with said base.

* * * * *